US009778608B2

(12) United States Patent
Saitoh et al.

(10) Patent No.: US 9,778,608 B2
(45) Date of Patent: Oct. 3, 2017

(54) CONTROL DEVICE AND NON-TRANSITORY RECORDING MEDIUM STORING CONTROL PROGRAM FOR IMAGE FORMING APPARATUS, AND METHOD FOR CONTROLLING THE IMAGE FORMING APPARATUS

(71) Applicants: Kazuya Saitoh, Kanagawa (JP); Takeshi Kojima, Kanagawa (JP); Sho Sekiguchi, Tokyo (JP); Tatsumi Yamada, Kanagawa (JP); Takuya Moriyama, Kanagawa (JP)

(72) Inventors: Kazuya Saitoh, Kanagawa (JP); Takeshi Kojima, Kanagawa (JP); Sho Sekiguchi, Tokyo (JP); Tatsumi Yamada, Kanagawa (JP); Takuya Moriyama, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 15/157,492

(22) Filed: May 18, 2016

(65) Prior Publication Data

US 2016/0342120 A1 Nov. 24, 2016

(30) Foreign Application Priority Data

May 22, 2015 (JP) ..... 2015-104501
Jan. 26, 2016 (JP) ..... 2016-012730

(51) Int. Cl.
*G03G 15/00* (2006.01)

(52) U.S. Cl.
CPC . *G03G 15/5004* (2013.01); *G03G 2215/0129* (2013.01)

(58) Field of Classification Search
USPC ..... 399/38, 42, 44, 75, 81, 82, 83, 85, 91, 399/94, 97
See application file for complete search history.

(56) References Cited

U.S. PATENT DOCUMENTS

2012/0230711 A1 9/2012 Shiori et al.
2014/0064756 A1* 3/2014 Sugiyama ..... G03G 15/55 399/44
2014/0362396 A1* 12/2014 Ishizuka ..... G06K 15/404 358/1.13

FOREIGN PATENT DOCUMENTS

JP 2012-198495 10/2012

* cited by examiner

*Primary Examiner* — Hoan Tran
(74) *Attorney, Agent, or Firm* — Harness, Dickey & Pierce, P.L.C.

(57) ABSTRACT

A control device for an image forming apparatus that transitions to a restricted mode which is a print mode to alternately transition between a printable state to perform a print operation, in which a predetermined print amount is printable, and a sleep state to stop a subsequent print operation for a predetermined sleep time after the print operation is performed, includes a print-operation determiner and a print controller. The print-operation determiner determines, when a print-operation execution request to the image forming apparatus is received in the sleep state, whether the image forming apparatus is to perform the subsequent print operation based on a print amount of the print-operation execution request. The print controller controls the subsequent print operation of the image forming apparatus according to a determination result of the print-operation determiner as to whether the image forming apparatus is to perform the subsequent print operation.

18 Claims, 9 Drawing Sheets

FIG. 4

| PRINT MODE | PRINT CONTROL |
|---|---|
| NON-RESTRICTED MODE | NORMAL PRINT CONTROL |
| RESTRICTED MODE 1 | LOW-SPEED PRINT CONTROL (DECREASE PRINT SPEED THAN IN NON-RESTRICTED MODE) |
| RESTRICTED MODE 2 | INTERMITTENT PRINT CONTROL (REPEAT PRINT CONTROL AND SLEEP STATE) |
| RESTRICTED MODE 3 | PRINT OPERATION STOP CONTROL |

FIG. 5

| INTERNAL TEMPERATURE: Ts | PRINT MODE | | | |
|---|---|---|---|---|
| | NON-RESTRICTED MODE | RESTRICTED MODE 1 | RESTRICTED MODE 2 | RESTRICTED MODE 3 |
| Ts ≥ TEMPERATURE TO EXECUTE RESTRICTED MODE 3 | EXECUTION OF RESTRICTED MODE 3 | EXECUTION OF RESTRICTED MODE 3 | EXECUTION OF RESTRICTED MODE 3 | CONTINUATION OF RESTRICTED MODE 3 |
| TEMPERATURE TO EXECUTE RESTRICTED MODE 3 > Ts ≥ TEMPERATURE TO CANCEL RESTRICTED MODE 3 | EXECUTION OF RESTRICTED MODE 2 | EXECUTION OF RESTRICTED MODE 2 | CONTINUATION OF RESTRICTED MODE 2 | CONTINUATION OF RESTRICTED MODE 3 |
| TEMPERATURE TO CANCEL RESTRICTED MODE 3 > Ts ≥ TEMPERATURE TO EXECUTE RESTRICTED MODE 2 | EXECUTION OF RESTRICTED MODE 2 | EXECUTION OF RESTRICTED MODE 2 | CONTINUATION OF RESTRICTED MODE 2 | EXECUTION OF RESTRICTED MODE 2 |
| TEMPERATURE TO EXECUTE RESTRICTED MODE 2 > Ts ≥ TEMPERATURE TO CANCEL RESTRICTED MODE 2 | EXECUTION OF RESTRICTED MODE 1 | CONTINUATION OF RESTRICTED MODE 1 | CONTINUATION OF RESTRICTED MODE 2 | EXECUTION OF RESTRICTED MODE 2 |
| TEMPERATURE TO CANCEL RESTRICTED MODE 2 > Ts ≥ TEMPERATURE TO EXECUTE RESTRICTED MODE 1 | EXECUTION OF RESTRICTED MODE 1 | CONTINUATION OF RESTRICTED MODE 1 | EXECUTION OF RESTRICTED MODE 1 | EXECUTION OF RESTRICTED MODE 1 |
| TEMPERATURE TO EXECUTE RESTRICTED MODE 1 > Ts ≥ TEMPERATURE TO CANCEL RESTRICTED MODE 1 | CONTINUATION OF NON-RESTRICTED MODE | CONTINUATION OF RESTRICTED MODE 1 | EXECUTION OF RESTRICTED MODE 1 | EXECUTION OF RESTRICTED MODE 1 |
| TEMPERATURE TO CANCEL RESTRICTED MODE 1 > Ts | CONTINUATION OF NON-RESTRICTED MODE | EXECUTION OF NON- RESTRICTED MODE | EXECUTION OF NON- RESTRICTED MODE | EXECUTION OF NON- RESTRICTED MODE |

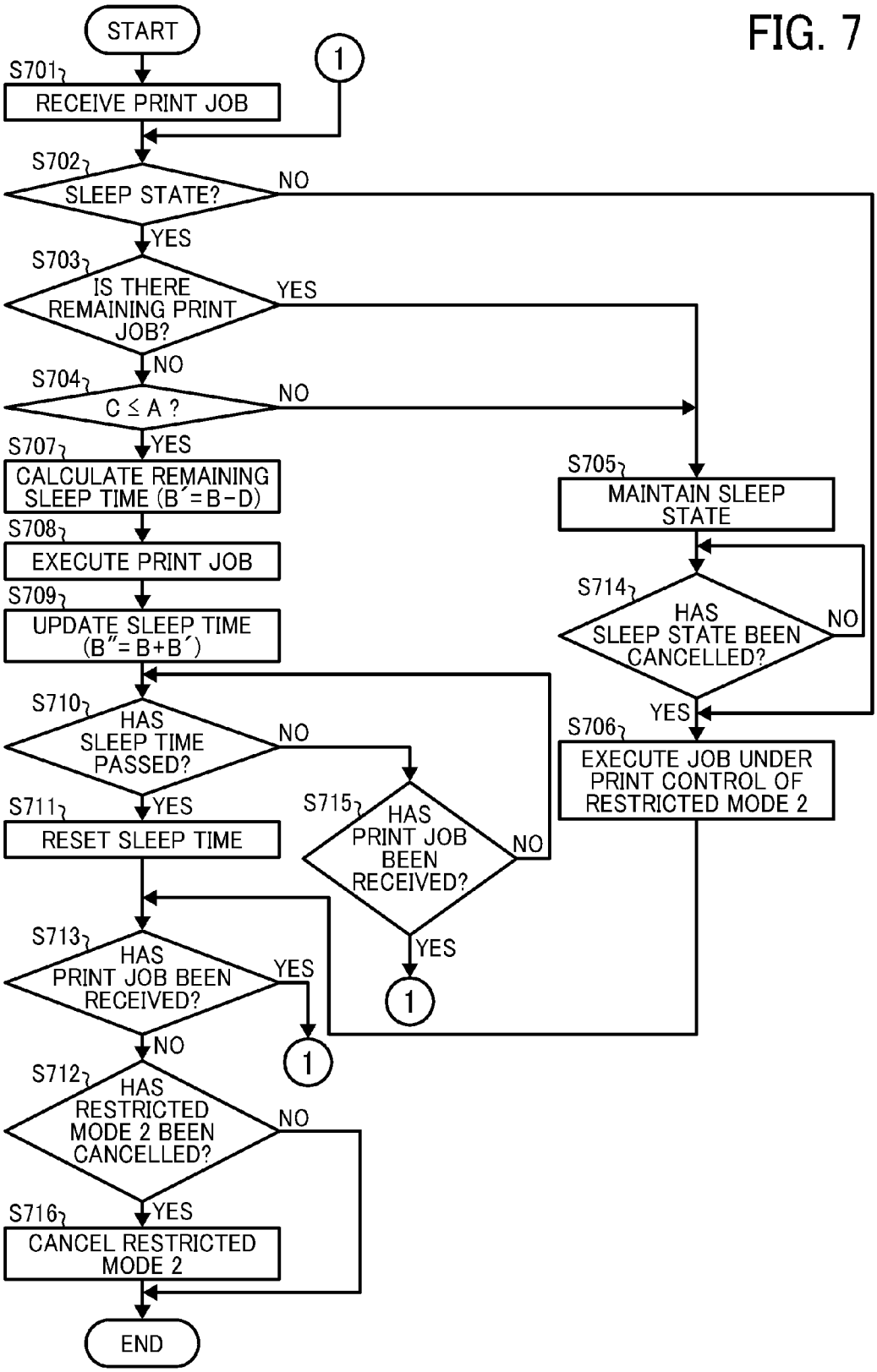
FIG. 7
START
S701
RECEIVE PRINT JOB
1
S702
SLEEP STATE?
NO
YES
S703
IS THERE REMAINING PRINT JOB?
YES
NO
S704
C ≤ A ?
NO
YES
S707
CALCULATE REMAINING SLEEP TIME (B´=B−D)
S708
EXECUTE PRINT JOB
S709
UPDATE SLEEP TIME (B″=B+B´)
S705
MAINTAIN SLEEP STATE
S714
HAS SLEEP STATE BEEN CANCELLED?
NO
YES
S706
EXECUTE JOB UNDER PRINT CONTROL OF RESTRICTED MODE 2
S710
HAS SLEEP TIME PASSED?
NO
YES
S711
RESET SLEEP TIME
S715
HAS PRINT JOB BEEN RECEIVED?
NO
YES
1
S713
HAS PRINT JOB BEEN RECEIVED?
YES
1
NO
S712
HAS RESTRICTED MODE 2 BEEN CANCELLED?
NO
YES
S716
CANCEL RESTRICTED MODE 2
END

CONTROL DEVICE AND NON-TRANSITORY RECORDING MEDIUM STORING CONTROL PROGRAM FOR IMAGE FORMING APPARATUS, AND METHOD FOR CONTROLLING THE IMAGE FORMING APPARATUS

CROSS-REFERENCE TO RELATED APPLICATIONS

This patent application is based on and claims priority pursuant to 35 U.S.C. §119(a) to Japanese Patent Applications No. 2015-104501, filed on May 22, 2015, and No. 2016-012730, filed on Jan. 26, 2016, in the Japan Patent Office, the entire disclosure of each of which is hereby incorporated by reference herein.

BACKGROUND

Technical Field

Aspects of the present disclosure relate to a control device and a non-transitory recording medium storing a control program for an image forming apparatus, and a method for controlling the image forming apparatus.

Related Art

Recently, image forming apparatuses have been widely used to output electronic information. As one type of image forming apparatus, for example, image forming apparatuses using electrophotographic are known.

When an electrophotographic image forming apparatus performs continuous printing for a long time, a developing device and a fixing device are continuously driven for a long time, thus increasing the internal temperature of the image forming apparatus. The rising of the internal temperature causes melting or aggregation of toner, and might cause a failure of the image forming apparatus or reduce print quality.

Hence, techniques have been proposed for controlling the internal temperature of an image forming apparatus so as not to be a predetermined temperature or more by a cooling fan or duct or alternately repeating of print operation and a sleep state.

SUMMARY

In an aspect of the present disclosure, there is provided a control device for an image forming apparatus that transitions to a restricted mode which is a print mode to alternately transition between a printable state to perform a print operation, in which a predetermined print amount is printable, and a sleep state to stop a subsequent print operation for a predetermined sleep time after the print operation is performed. The control device includes a print-operation determiner and a print controller. The print-operation determiner determines, when a print-operation execution request to the image forming apparatus is received in the sleep state, whether the image forming apparatus is to perform the subsequent print operation based on a print amount of the print-operation execution request. The print controller controls the subsequent print operation of the image forming apparatus according to a determination result of the print-operation determiner as to whether the image forming apparatus is to perform the subsequent print operation.

In another aspect of the present disclosure, there is provided a non-transitory recording medium storing a control program for causing an image forming apparatus that transitions to a restricted mode which is a print mode to alternately transition between a printable state to perform a print operation, in which a predetermined print amount is printable, and a sleep state to stop a subsequent print operation for a predetermined sleep time after the print operation is performed, to execute determining and controlling. The determining includes determining, when a print-operation execution request to the image forming apparatus is received in the sleep state, whether the image forming apparatus is to perform the subsequent print operation based on a print amount of the print-operation execution request. The controlling includes controlling the subsequent print operation of the image forming apparatus according to a determination result as to whether the image forming apparatus is to perform the subsequent print operation.

In another aspect of the present disclosure, there is provided a method for controlling an image forming apparatus that transitions to a restricted mode which is a print mode to alternately transition between a printable state to perform a print operation, in which a predetermined print amount is printable, and a sleep state to stop a subsequent print operation for a predetermined sleep time after the print operation is performed. The method includes determining, when a print-operation execution request to the image forming apparatus is received in the sleep state, whether the image forming apparatus is to perform the subsequent print operation based on a print amount of the print-operation execution request; and controlling the subsequent print operation of the image forming apparatus according to a determination result as to whether the image forming apparatus is to perform the subsequent print operation.

BRIEF DESCRIPTION OF THE SEVERAL VIEWS OF THE DRAWINGS

A more complete appreciation of the disclosure and many of the attendant advantages and features thereof can be readily obtained and understood from the following detailed description with reference to the accompanying drawings, wherein:

FIG. 4 is a table showing print modes in which an image forming apparatus according to an embodiment of the present disclosure can operate, and print control in each print mode;

FIG. 5 is a table showing examples of transition conditions in the print modes of an image forming apparatus according to an embodiment of the present disclosure;

FIG. 7 is a flowchart for explaining print control when an image forming apparatus according to an embodiment of the present disclosure is in a restricted mode 2;

Figure 1:
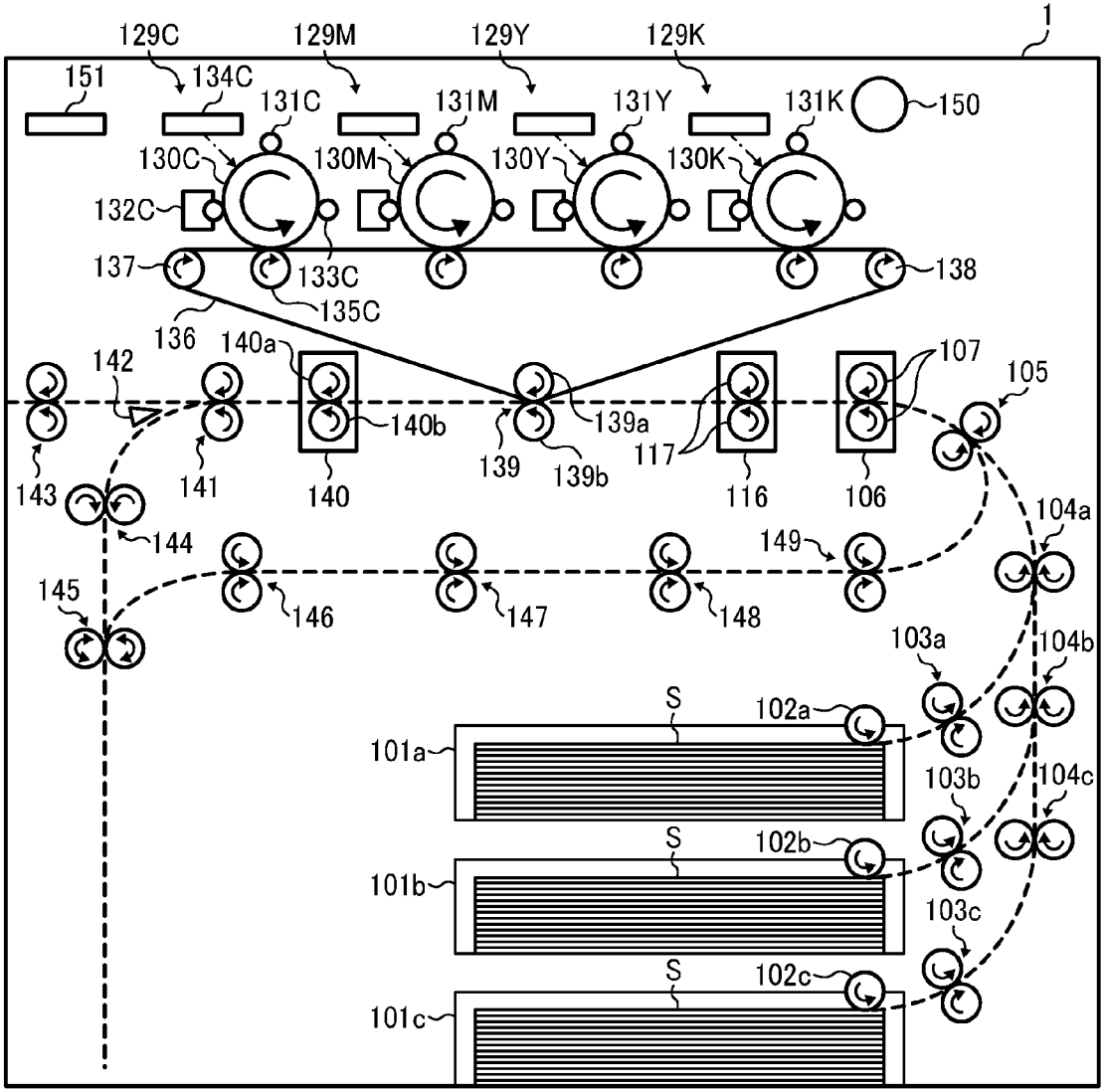
FIG. 1 is a cross-sectional view of an image forming apparatus according to an embodiment of the present disclosure illustrated from a main scanning direction.

The accompanying drawings are intended to depict example embodiments of the present invention and should not be interpreted to limit the scope thereof. The accompanying drawings are not to be considered as drawn to scale unless explicitly noted.

DETAILED DESCRIPTION

The terminology used herein is for the purpose of describing particular embodiments only and is not intended to be limiting of the present invention. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

In describing example embodiments shown in the drawings, specific terminology is employed for the sake of clarity. However, the present disclosure is not intended to be limited to the specific terminology so selected and it is to be understood that each specific element includes all technical equivalents that operate in a similar manner.

First Embodiment

Hereinafter, embodiments of the present disclosure will be detailedly described referring to the drawings. In the present embodiment, an image forming apparatus using electrophotographic among image forming apparatuses used to output electronic information will be exemplified.

First, a general arrangement of an image forming apparatus 1 according to the present embodiment will be described referring to FIG. 1. FIG. 1 is a cross-sectional view illustrating the image forming apparatus 1 according to the present embodiment illustrated from a main scanning direction.

As illustrated in FIG. 1, the image forming apparatus 1 includes multiple image forming units of an image forming unit 129C, an image forming unit 129M, an image forming unit 129Y, and an image forming unit 129K in this order from an upstream side of a conveyance direction of a transfer belt 136 along the transfer belt 136 stretched over between a drive roller 137, a driven roller 138 and a secondary transfer roller 139*a*.

These image forming units 129C, 129M, 129Y, and 129K each have a different color of a toner image to be formed, but have common internal configurations. The image forming unit 129C forms a cyan image, the image forming unit 129M forms a magenta image, the image forming unit 129Y forms a yellow image, and the image forming unit 129K forms a black image.

Note that, the configuration elements of the image forming units 129M, 129Y, and 129K are the same as that of the image forming unit 129C. Thus, the image forming unit 129C will be concretely described below, but the configuration elements of the other image forming units will be only indicated in the drawings with the reference codes distinguished by "M, Y, and K" from "C" attached to the configuration elements of the image forming unit 129C.

The image forming unit 129C includes a photoconductor drum 130C which serves as a photoconductor, and a charging device 131C, a developing device 132C, a charge remover 133C, and a toner collection unit which are disposed around the photoconductor drum 130C.

To form an image, in the image forming unit 129C, the outer circumferential surface of the photoconductor drum 130C is uniformly charged by the charging device 131C in the dark.

Then, an optical writing device 134C irradiates the uniformly charged photoconductor drum 130C with light corresponding to a cyan image, and thereby the writing is electrostatically performed. Thus, an electrostatic latent image is formed on the outer circumferential surface of the photoconductor drum 130C. The developing device 132C makes the electrostatic latent image visible with cyan toner, and thereby the image forming unit 129C forms a cyan toner image on the outer circumferential surface of the photoconductor drum 130C.

A primary transfer roller 135C presses against the photoconductor drum 130C, and thus the toner image is transferred on the transfer belt 136. By this transfer, an image with cyan toner, that is, a cyan intermediate transfer image is formed on the transfer belt 136.

At this time, a transfer electric field is formed between the photoconductor drum 130C and the primary transfer roller 135C by a transfer bias applied to the primary transfer roller 135C. Then, the toner image is transferred from the photoconductor drum 130C to the transfer belt 136 by the actions of the transfer electric field.

When it is completed to form the cyan intermediate transfer image on the transfer belt 136, after the toner collection unit recovers the residual toner on the outer circumferential surface of the photoconductor drum 130C, the charge remover 133C diselectrifies the outer circumferential surface of the photoconductor drum 130C. Then, the image forming unit 129C prepares to form a next image and is in standby.

The cyan intermediate transfer image transferred on the transfer belt 136 in the above manner is to conveyed the next image forming unit 129M by moving the transfer belt 136 by a drive motor, the drive roller 137, the driven roller 138, and the secondary transfer roller 139*b*.

The image forming unit 129M forms a magenta toner image on a photoconductor drum 130M with the same process as the image forming process in the image forming unit 129C. Then, the image forming unit 129M superimposes the magenta toner image on the already formed cyan intermediate transfer image, and transfers the superimposed image on the transfer belt 136. By this transfer, an image with magenta toner, that is, a magenta intermediate transfer image is formed on the transfer belt 136.

The cyan and magenta intermediate transfer images formed on the transfer belt 136 are sequentially conveyed to the next image forming units of the image forming unit 129Y and the image forming unit 129K. Then, by the same operations, a yellow toner image formed on a photoconductor drum 130Y and a black toner image formed on a photoconductor drum 130K are superimposed on the already formed intermediate transfer image, and transferred on the transfer belt 136.

By this transfer, an image with a yellow toner and an image with black toner, that is, a yellow intermediate transfer image and a black intermediate transfer image are formed on the transfer belt 136. In this manner, a full color intermediate transfer image is formed on the transfer belt 136.

When the full color intermediate transfer image is formed on the transfer belt 136 in this manner, a sheet S stored in a sheet supply tray 101 (101*a*, 101*b*, or 101*c*) is supplied by a separation roller 102 (102*a*, 102*b*, or 102*c*) and paired sheet supply rollers 103 (103*a*, 103*b*, or 103*c*), 104 (104*a*, 104*b*, and/or 104*c*), and 105. Then, the supplied sheet S is conveyed toward a relay unit 106. Note that, sheet supply trays 101*a*, 101*b*, and 101*c* each store different sheet types of sheets in a sheet size, sheet thickness, or sheet material.

Paired relay rollers 107 convey the sheet S toward a nipping portion of suspended paired registration rollers 117 in a registration unit 116, and thereby the relay unit 106, to which the sheet S is conveyed, corrects the skew of the sheet with respect to paired secondary transfer rollers 139. Then, the relay unit 106 further conveys the sheet to the downstream side of the conveyance direction.

Thereafter, in the registration unit 116, the paired registration rollers 117 convey, in accordance with the conveyance timing of the transfer belt 136, the sheet S, whose skew is corrected, toward a nipping portion of the paired secondary transfer rollers 139, that is, a secondary transfer position.

A secondary transfer roller 139*a* and a secondary transfer roller 139*b* simultaneously nip the sheet S and the transfer belt 136, and thereby the paired secondary transfer rollers 139 transfers the full color intermediate transfer image formed on the transfer belt 136 to the sheet S at the secondary transfer position. Thus, an image is formed on a sheet surface of the sheet S.

A fixing unit 140 fixes the image by pressing the sheet S nipped by a fixing roller 140*a* and a fixing roller 140*b* while heating the sheet S.

Paired separation rollers 141 guide the sheet S, on which the image is fixed, to paired ejection rollers 143, or to paired reverse-passage entry rollers 144.

When a separator 142 is switched to a reverse passage, the paired reverse-passage entry rollers 144 convey the sheet S toward paired reversible rollers 145. Then, the paired reversible rollers 145 reverse the front and rear surfaces of the sheet S by inverting the direction of rotation at an appropriate reverse timing of the sheet S. The sheet S, whose front and rear surfaces are reversed in this manner, is conveyed toward the relay unit 106 by paired reverse rollers 146, 147, 148, and 149. Then, images are formed on the both sides of the sheet S, whose front and rear surfaces are reversed, conveyed to the relay unit 106 by the same process.

The image forming apparatus 1 further includes an internal cooling fan 150 which cools the inside of the image forming apparatus, and an internal temperature thermistor 151 which measure the temperature inside the image forming apparatus (hereinafter, referred to as an internal temperature). The internal temperature thermistor 151 measures the internal temperature at a predetermined time interval.

Figure 2:
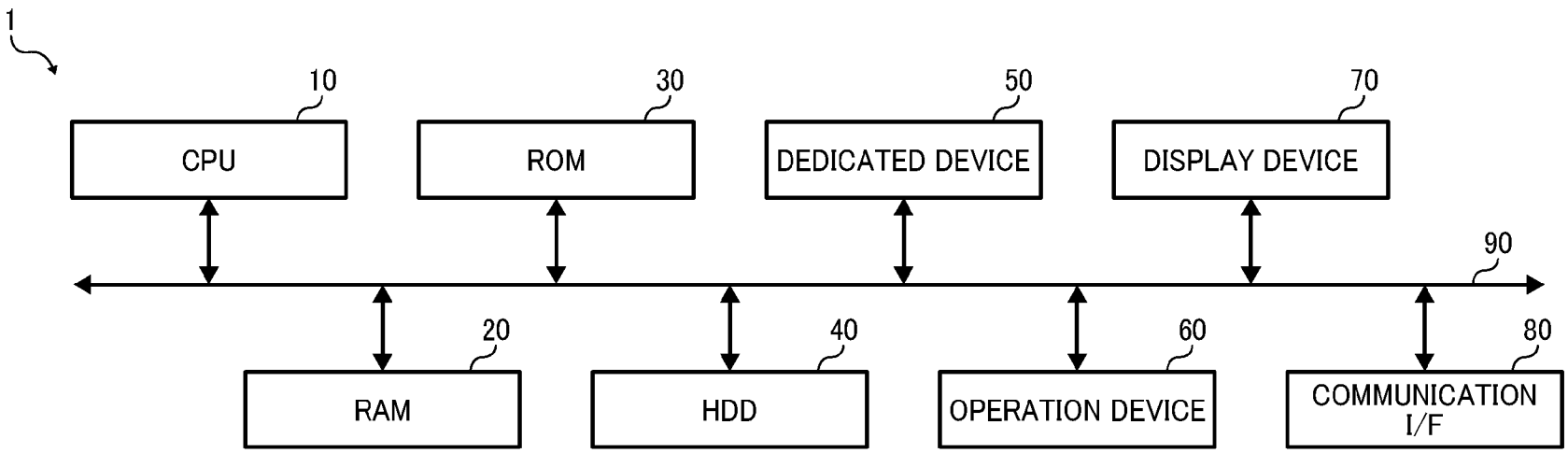
FIG. 2 is a block diagram schematically illustrating a hardware configuration of an image forming apparatus according to an embodiment of the present disclosure.

Next, a hardware configuration the image forming apparatus 1 according to the present embodiment will be described referring to FIG. 2. FIG. 2 is a block diagram schematically illustrating the hardware configuration of the image forming apparatus 1 according to the present embodiment.

As illustrated in FIG. 2, the image forming apparatus 1 according to the present embodiment is configured by connecting a central processing unit (CPU) 10, a random access memory (RAM) 20, a read only memory (ROM) 30, a hard disk drive (HDD) 40, a dedicated device 50, an operation device 60, a display device 70, and a communication interface (I/F) 80 through a bus 90.

The CPU 10 is a processor, and controls operations of the entire image forming apparatus 1. The RAM 20 is a volatile storage medium capable of quickly reading and writing information, and used for a working area when the CPU 10 processes information. The ROM 30 is a read-only non-volatile storage medium, and stores programs, such as firmware.

The HDD 40 is a non-volatile storage medium capable of reading and writing information, and stores various data, such as image data, an operating system (OS), various control programs, and various programs, such as an application program.

The dedicated device 50 is hardware to implement dedicated functions in the image forming apparatus 1. In other words, the dedicated device 50 is hardware to implement functions dedicated to a printer, a facsimile machine, a scanner, and a copier. The image forming apparatus 1 according to the present embodiment includes, as described above, an imaging function, an image forming function, and a communication function, and thus is a multifunction peripheral (MFP) usable as a printer, a facsimile machine, a scanner, and a copier.

The operation device 60 is a user interface to input information to the image forming apparatus 1, and is implemented by an input device, such as a keyboard, a mouse, an input key, or a touch panel.

The display device 70 is a visual user interface for a user to check a state of the image forming apparatus 1, and is implemented by a display device, such as a light emitting diode (LED), or an output device, such as a liquid crystal display (LCD).

The communication I/F 80 is an interface for the image forming apparatus 1 to communicate with other devices, and uses an interface, such as Ethernet (registered trademark), Universal Serial Bus (USB), Bluetooth (registered trademark), Wireless Fidelity (Wi-Fi) (registered trademark), FeliCa (registered trademark), Peripheral Component Interconnect Express (PCIe), or The Institute of Electrical and Electronics Engineers (IEEE) standard.

In the above described hardware configuration, a program stored in a storage medium, such as the ROM 30 or the HDD 40, is read in the RAM 20, the CPU 10 executes the program loaded in the RAM 20, and thereby a software controller is configured. The combination of the software controller configured in this manner and the hardware configures functional blocks to implement the functions of the image forming apparatus 1 according to the present embodiment.

Figure 3:
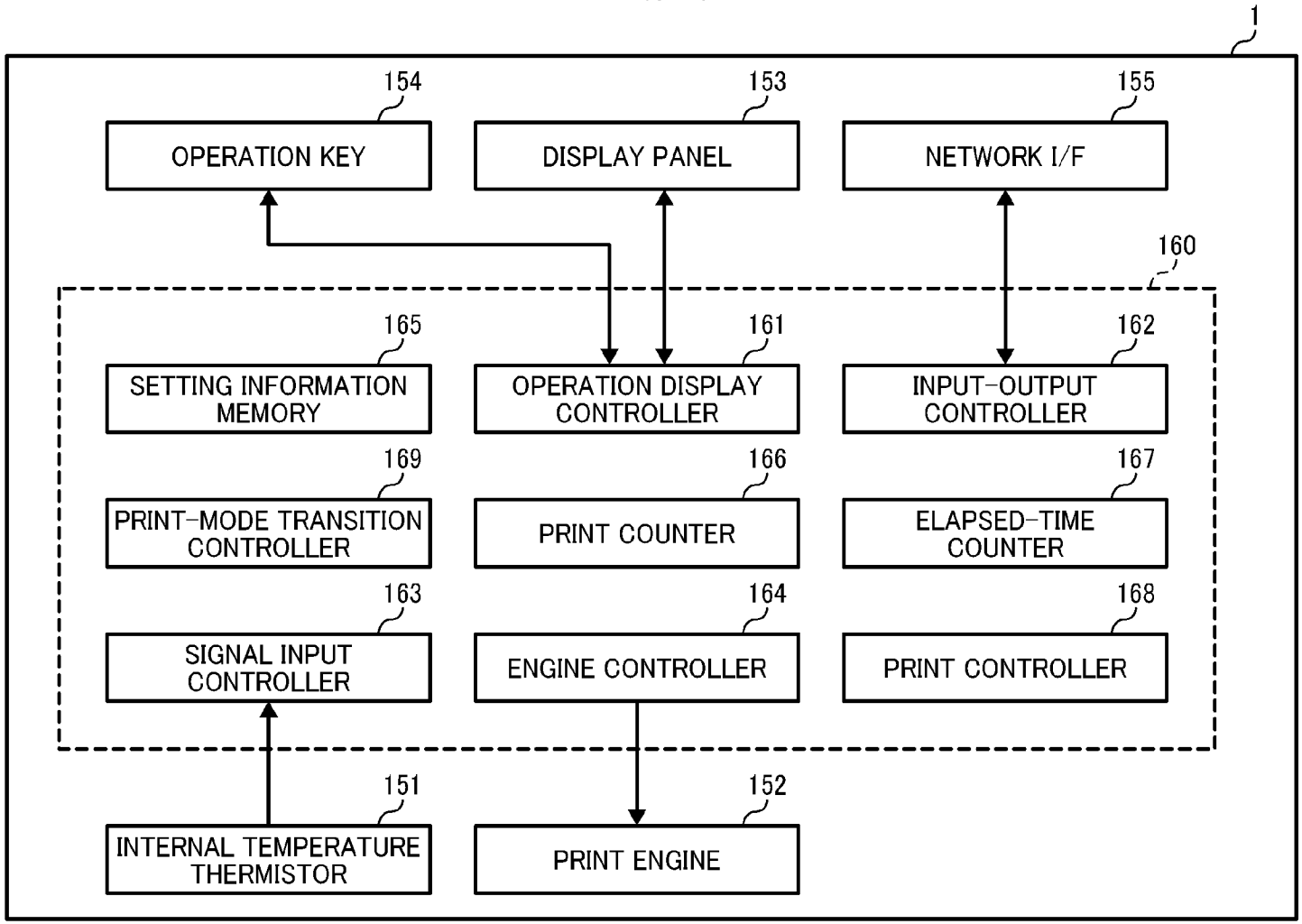
FIG. 3 is a block diagram schematically illustrating a functional configuration of an image forming apparatus according to an embodiment of the present disclosure.

Next, a functional configuration of the image forming apparatus 1 according to the present embodiment will be described referring to FIG. 3. FIG. 3 is a block diagram schematically illustrating the functional configuration of the image forming apparatus 1 according to the present embodiment.

As illustrated in FIG. 3, the image forming apparatus 1 according to the present embodiment includes an internal temperature thermistor 151, a print engine 152, a display panel 153, an operation key 154, a network interface (I/F) 155, and a control device 160.

Furthermore, the control device 160 includes an operation display controller 161, an input-output controller 162, a signal input controller 163, an engine controller 164, a setting information memory 165, a print counter 166, an elapsed-time counter 167, a print controller 168, and a print-mode transition controller 169.

The internal temperature thermistor 151 is implemented by the dedicated device 50 illustrated in FIG. 2.

The print engine 152 is an image forming unit which draws an image by performing an image formation output to a sheet, and is an image forming device by electrophotographic as a specific aspect. The print engine 152 is implemented by the dedicated device 50 illustrated in FIG. 2.

The display panel 153 is an output interface which visually displays a state of the image forming apparatus 1 and is also an input interface as a touch panel for a user to directly operate the image forming apparatus 1 or to input information to the image forming apparatus 1. In other words, the display panel 153 includes a function to display an image to receive an operation from a user. The display panel 153 is implemented by the operation device 60 and the display device 70 which are illustrated in FIG. 2.

The operation key 154 is an input interface for a user to directly operate the image forming apparatus 1 or to input information to the image forming apparatus 1. The operation key 154 is implemented by the operation device 60 illustrated in FIG. 2.

The network I/F 155 is an interface to communicate with an information processing apparatus, such as a personal computer (PC) operated by a user. The network I/F 155 is implemented by the communication I/F 80 illustrated in FIG. 2.

The control device 160 is configured by combination of hardware and software. In other words, the control device 160 is configured by hardware, such as an integrated circuit, and the software controller configured by the execution, by the CPU 10, of the program which is stored in a storage medium, such as the ROM 30 or the HDD 40, and loaded in the RAM 20. That is, in the present embodiment, the control device 160 functions as a control device of the image forming apparatus 1.

The operation display controller 161 displays information on the display panel 153, or transmits the information input through the display panel 153 or the operation key 154 to the units of the control device 160. The input-output controller 162 transmits the information input through the network I/F 155 to the units of the control device 160.

The signal input controller 163 transmits the detection signal input from the internal temperature thermistor 151 to the units of the control device 160. The engine controller 164 controls or drives the print engine 152. The setting information memory 165 stores various setting information necessary for the image forming apparatus 1 to operate.

The print counter 166 counts the number of sheets printed by the image forming apparatus 1 in a certain period. In other words, the print counter 166 functions as a print amount counter in the present embodiment.

The elapsed-time counter 167 counts an elapsed time from a certain timing. In other words, the elapsed-time counter 167 functions as an elapsed-time counter in the present embodiment. The print controller 168 controls print operations.

The print-mode transition controller 169 controls transition between print modes of the image forming apparatus 1. Here, the print modes in which the image forming apparatus 1 according to the present embodiment can operate, and transition conditions and cancellation conditions in the print modes will be described referring to FIGS. 4 to 6.

Figure 6:
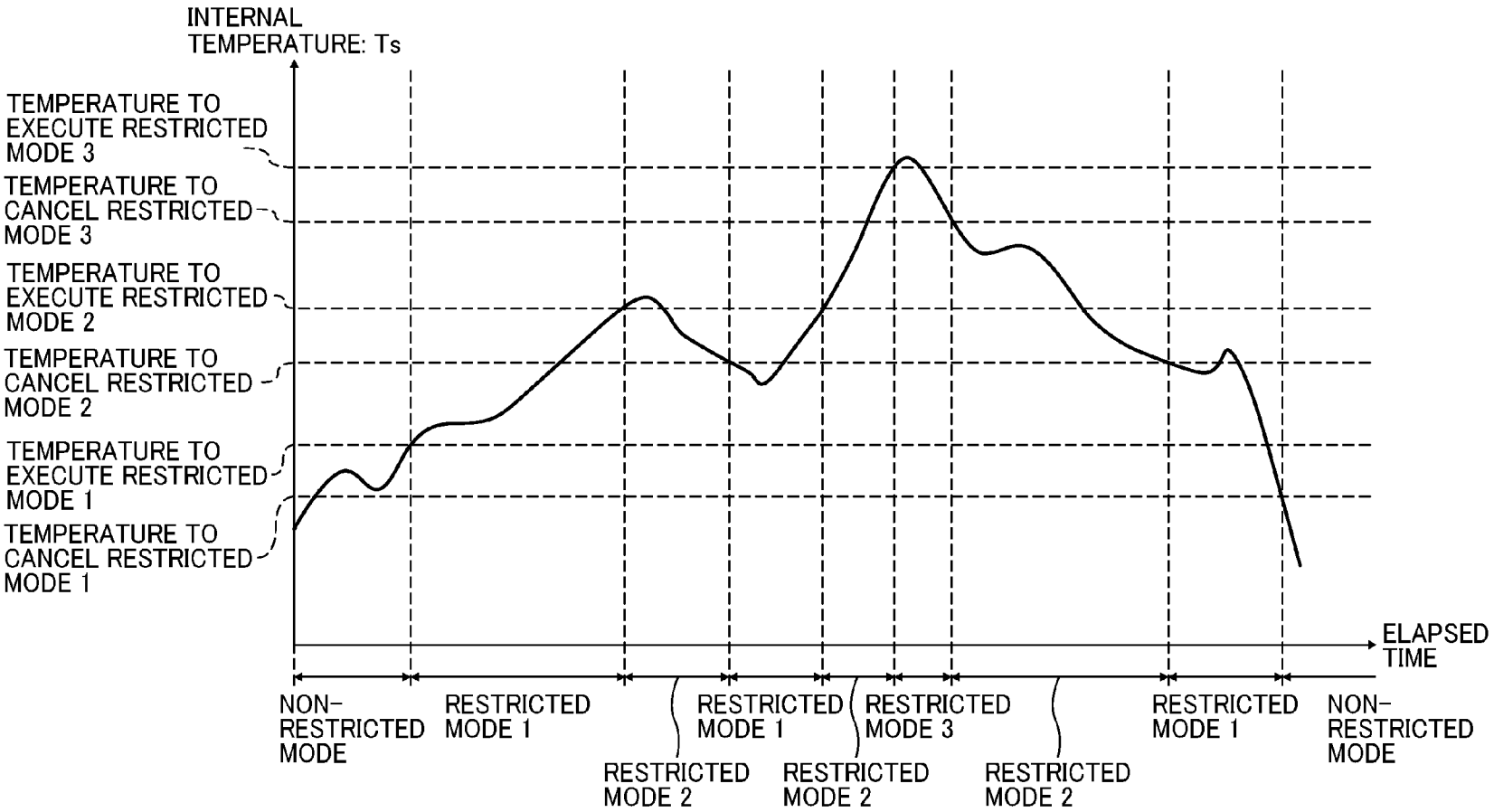
FIG. 6 is a graph illustrating a state when an image forming apparatus according to an embodiment of the present disclosure transitions between the print modes.

FIG. 4 is a table showing the print modes in which the image forming apparatus 1 according to the present embodiment can operate, and the print control in each print mode. FIG. 5 is a table showing examples of the transition conditions in the print modes of the image forming apparatus 1 according to the present embodiment. FIG. 6 is a graph illustrating a state when the image forming apparatus 1 according to the present embodiment transitions between the print modes.

As illustrated in FIG. 4, the image forming apparatus 1 according to the present embodiment can operate in four print modes of a non-restricted mode, a restricted mode 1, a restricted mode 2, and a restricted mode 3. Furthermore, as illustrated in FIG. 5, an execution temperature and a cancellation temperature are set to each print mode.

Then, when the internal temperature in a print mode rises above the execution temperature set to the print mode, the image forming apparatus 1 according to the present embodiment transitions to the print mode corresponding to the high execution temperature.

On the other hand, when the internal temperature in a print mode falls below a cancellation temperature set to the print mode, the image forming apparatus 1 according to the present embodiment transitions to the print mode corresponding to the low execution temperature.

As illustrated in FIG. 4, the non-restricted mode is a print mode to perform normal print control, and the print operation is performed at a standard print speed.

The restricted mode 1 is a print mode to perform low-speed print control, and the print operation is performed at a lower print speed than that in the non-restricted mode. Accordingly, by transitioning from the non-restricted mode to the restricted mode 1, the image forming apparatus 1 according to the present embodiment can suppress rising of the internal temperature.

The restricted mode 2 is a print mode to perform intermittent print control, and to alternately repeatedly transition between a print operation and a sleep state. In other words, when transitioning to the restricted mode 2, the image forming apparatus 1 according to the present embodiment becomes a state (hereinafter, referred to as a "printable state") in which the print operation can be continuously performed for the upper limit number which is the preset number of printed sheets (hereinafter, referred to as "the continuous printing upper limit number"). Accordingly, by transitioning from the restricted mode 1 to the restricted mode 2, the image forming apparatus 1 according to the present embodiment can suppress rising of the internal temperature.

In the printable state, when receiving a print job which is an execution request of a print operation, the image forming apparatus 1 according to the present embodiment performs the print operation for the continuous printing upper limit number, and then transitions to the sleep state. At this time, the image forming apparatus 1 according to the present embodiment performs the print operation in the same print control as that in the restricted mode 1. Furthermore, when being in the sleep state, the image forming apparatus 1 according to the present embodiment stops power supply to a fixing heater of the fixing unit 140 to suppress rising of the internal temperature.

Then, when a predetermined time passes after transitioning to the sleep state (hereinafter, referred to as a "sleep time"), the image forming apparatus 1 according to the present embodiment transitions to the printable state again.

The restricted mode 3 is a print mode to perform print-operation stop control, and a print operation is completely stopped. At this time, the image forming apparatus 1 according to the present embodiment stops power supply to the fixing heater of the fixing unit 140 to suppress rising of the internal temperature. Accordingly, by transitioning from the restricted mode 2 to the restricted mode 3, the image forming apparatus 1 according to the present embodiment can suppress rising of the internal temperature.

Note that, the execution temperature of the restricted mode 3 is set as a temperature which might cause a breakdown of the image forming apparatus due to progress of melting or aggregation of the toner or due to damage by heat, or deterioration in print quality, when the internal temperature reaches the execution temperature. Thus, the restricted mode 3 is to be performed as a safe mode in emergency.

As illustrated in FIGS. 5 and 6, while the print mode is the non-restricted mode, when an internal temperature: Ts is lower than the execution temperature of the restricted mode 1, the non-restricted mode is maintained.

While the print mode is the non-restricted mode, when the internal temperature: Ts rises and reaches the execution temperature of the restricted mode 1, the print mode transitions from the non-restricted mode to the restricted mode 1. Accordingly, it is possible to suppress rising of the internal temperature.

Although the low-speed printing can suppress rising of the internal temperature compared with the normal speed printing, the internal temperature rises when printing is continuously performed in the low-speed printing, or when the image forming apparatus is installed in a high temperature environment. If the internal temperature rises due to the above reasons, when the internal temperature: Ts in the restricted mode 1 is higher than the cancellation temperature of the restricted mode 1 and is lower than the execution temperature of the restricted mode 2, the restricted mode 1 is continued.

In contrast, the internal temperature may fall when continuous printing is not performed in the low-speed printing, or when the image forming apparatus is installed in a low temperature environment. When the internal temperature: Ts in the restricted mode 1 falls due to the above reasons and is lower than the cancellation temperature of the restricted mode 1, the print mode transitions to the non-restricted mode. Thus, the low-speed printing is changed to the normal printing, and it is possible to suppress deterioration in convenience.

On the other hand, the internal temperature may keep rising when printing is continuously performed in the low-speed printing or when the image forming apparatus is installed in a high temperature environment. When the internal temperature: Ts in the restricted mode 1 rises and reaches the execution temperature of the restricted mode 2, the print mode transitions to the restricted mode 2. Accordingly, by transitioning from the restricted mode 1 to the restricted mode 2, the image forming apparatus 1 according to the present embodiment can suppress rising of the internal temperature compared with continuing the restricted mode 1.

Thereafter, when the internal temperature: Ts in the restricted mode 2 is higher than the cancellation temperature of the restricted mode 2 and is lower than the execution temperature of the restricted mode 3, the restricted mode 2 is continued.

On the other hand, when the internal temperature: Ts in the restricted mode 2 falls and becomes lower than the cancellation temperature of the restricted mode 2, the print mode transitions to the restricted mode 1. Thus, the sleep state can be eliminated, and it is possible to suppress deterioration in convenience.

Furthermore, when the internal temperature: Ts in the restricted mode 2 rises and reaches the execution temperature of the restricted mode 3, the print mode transitions to the restricted mode 3. By transitioning from the restricted mode 2 to the restricted mode 3, it is possible to suppress rising of the internal temperature compared with continuing the restricted mode 2. Thus, it is possible to prevent a breakdown of a device which might be caused when the image forming apparatus operates at the execution temperature of the restricted mode 3.

Note that, in the present embodiment, the contents of the print control in each print mode illustrated in FIG. 4, and information, which is related to the execution temperature and the cancellation temperature, the continuous printing upper limit number, and the sleep time, set to each print mode illustrated in FIG. 5 are stored in the setting information memory 165 in advance. Then, the print controller 168 refers to the information as needed, and controls the print operation.

Next, the print control when the print mode is the restricted mode 2 will be described referring to FIG. 7. FIG. 7 is a flowchart for explaining the print control when the image forming apparatus 1 according to the present embodiment is in the restricted mode 2. Note that, it is assumed that a sleep time in the sleep state is B seconds in the following description.

As illustrated in FIG. 7, while the image forming apparatus 1 according to the present embodiment is in the restricted mode 2, when the input-output controller 162 receives a print job C (S701), the print controller 168 determines whether the image forming apparatus 1 is in the sleep state in the intermittent print control (FIG. 4) (S702). Note that, it is assumed that the number of printed sheets of the received print job C is C number of sheets.

Then, when determining that the image forming apparatus 1 is not in the sleep state in the determination processing in S702 (S702/NO), the print controller 168 controls the print operation so as to perform the print job C in the intermittent print control (S706).

Thereafter, before the restricted mode 2 is cancelled (S712/NO), when another print job is received (S713/YES), the print controller 168 performs the processing in S702 and subsequent steps. When another print job is not received (S713/NO), if the restricted mode 2 is a cancellable temperature (S712/YES), the restricted mode 2 is cancelled (S716), and the print control in the restricted mode 2 is terminated. When the restricted mode 2 is not a cancellable temperature (S712/No), the print control is terminated while the restricted mode 2 is maintained.

On the other hand, when determining that the image forming apparatus 1 is in the sleep state in the determination processing in S702 (S702/YES), the print controller 168 determines whether there is an unperformed print job (hereinafter, referred to as a "remaining print job") whose number of printed sheets exceeds a predetermined number of sheets to be printed (hereinafter, referred to as a "predetermined number of printed sheets") (S703). It is assumed that the predetermined number of printed sheets is A number of sheets in the following description.

Note that, although the predetermined number of printed sheets may be set to any number of sheets, when the predetermined number of printed sheets is set to equal to or less than the continuous printing upper limit number, it is possible to efficiently suppress rising of the internal temperature. Furthermore, in the present embodiment, the information related to the predetermined number of printed sheets is stored in the setting information memory 165 in advance. Then, the print controller 168 refers to the information as needed, and controls the print operation.

When determining that there is a remaining print job in the determination processing in S703 (S703/YES), the print controller 168 maintains the sleep state (S705).

Then, when the sleep state is cancelled and the image forming apparatus 1 transitions to the printable state (S714/YES), the print controller 168 controls the print operation to perform the remaining print job and the print job C in the intermittent print control (S706), and performs the processing in S713.

On the other hand, when determining that there is no remaining print job in the determination processing in S703 (S703/NO), the print controller 168 determines whether the number of printed sheets C is equal to or less than the predetermined number of printed sheets A (S704). In other words, in the present embodiment, the print controller 168 performs the determination as a print-operation determiner.

When determining that the number of printed sheets C is not equal to or less than the predetermined number of printed sheets A in the determination processing in S704 (S704/NO), the print controller 168 maintains the sleep state (S705).

Then, when the sleep state is cancelled and the image forming apparatus 1 transitions to the printable state (S714/YES), the print controller 168 controls the print operation so as to perform the print job C in the intermittent print control (S706), and performs the processing in S713.

On the other hand, when determining that the number of printed sheets C is equal to or less than the predetermined number of printed sheets A in the determination processing in S704 (S704/YES), the print controller 168 calculates the difference between the sleep time B and an elapsed time D after transitioning to the sleep state (hereinafter, referred to as a "remaining sleep time") (S707). It is assumed that the remaining sleep time is B' seconds in the following description. At this time, the elapsed-time counter 167 counts the elapsed time D.

Then, the print controller 168 controls the print operation so as to perform the print job C although the image forming apparatus 1 is in the sleep state (S708), and updates the sleep time B to (B+B') seconds as a sleep time after performing the print job C (S709). It is assumed that the sleep time after updating is B" seconds in the following description.

As described above, when receiving a print job in the sleep state in the restricted mode 2, the image forming apparatus 1 according to the present embodiment is configured to perform the print job, although being in the sleep state, if the number of printed sheets of the print job is equal to or less than the predetermined number of printed sheets. Accordingly, the image forming apparatus 1 according to the present embodiment can enhance the convenience.

Then, when performing the print job C in the sleep state in the restricted mode 2, the image forming apparatus 1 according to the present embodiment is configured so as to update the sleep time after performing the print job C according to the elapsed time D after transitioning to the sleep state and until performing the print job C, that is, according to the remaining sleep time B'. Accordingly, although performing the print job C in the sleep state in the restricted mode 2, the image forming apparatus 1 according to the present embodiment can suppress rising of the internal temperature.

For example, in the case of a conventional image forming apparatus, if a print job whose number of printed sheets is only one is received when 50 seconds passes after transitioning to a sleep state whose sleep time is set to 60 seconds, a user is required to wait for ten seconds to print a sheet.

In such a case, the image forming apparatus 1 according to the present embodiment performs the print job although being in the sleep state, then is to be in a sleep state for 70 seconds as a sleep time after updating, and can achieve both convenience and suppressing rising of the internal temperature.

Accordingly, the image forming apparatus 1 according to the present embodiment can achieve convenience and suppressing rising of the internal temperature without adding a cooling device, such as a cooling fan or a duct. Thus, the image forming apparatus 1 according to the present embodiment can suppress rising of the internal temperature with a simple configuration without deteriorating convenience.

Thereafter, before the sleep time B" passes (S710/NO), when another print job is received (S715/YES), the print controller 168 performs the processing in S702 and subsequent steps. On the other hand, after the sleep time B" passes, when the sleep state is cancelled, and the image forming apparatus 1 transitions to the printable state (S710/YES), the print controller 168 resets the sleep time B" to the initial sleep time B (S711), and performs the processing in S713.

As described above, when receiving a print job in the sleep state in the restricted mode 2, the image forming apparatus 1 according to the present embodiment is configured to perform the print job, although being in the sleep state, if the number of printed sheets of the print job is equal to or less than the predetermined number of printed sheets. Accordingly, the image forming apparatus 1 according to the present embodiment can enhance the convenience.

Then, when receiving a print job in the sleep state in the restricted mode 2, the image forming apparatus 1 according to the present embodiment is configured so as to update a sleep time after performing the print job according to an elapsed time after transitioning to the sleep state and until performing the print job, that is, according to a remaining sleep time. Accordingly, although performing a print job in the sleep state in the restricted mode 2, the image forming apparatus 1 according to the present embodiment can suppress rising of the internal temperature.

Thus, the image forming apparatus 1 according to the present embodiment can achieve both convenience and suppressing rising of the internal temperature without adding a cooling device, such as a cooling fan or a duct. Thus, the image forming apparatus 1 according to the present embodiment can suppress rising of the internal temperature with a simple configuration without deteriorating convenience.

Note that, in the present embodiment, when performing a print job in the sleep state, the image forming apparatus 1 is configured so as to update (B+B') the sleep time after performing the print job according to an elapsed time after transitioning the sleep state and until performing the execution job, that is, according to a remaining sleep time.

In addition, when performing a print job in the sleep state, the image forming apparatus 1 is only required to be configured so as to update the sleep time after performing the print job to a sleep time longer than the initial sleep time B.

Furthermore, when performing a print job in the sleep state, the image forming apparatus 1 updates the sleep time after performing the print job to (B+B') seconds in the present embodiment, but may update the sleep time according to the number of printed sheets of the print job.

In other words, when performing a print job in the sleep state, the image forming apparatus 1 may be configured so as to update the sleep time to become longer as the number of printed sheets of the print job is larger. This is because that the internal temperature rises more as the number of printed sheets is larger, and it takes a long time for the internal temperature to fall to a certain temperature after transitioning the sleep state.

Furthermore, when receiving a print job in the sleep state, the image forming apparatus 1 determines whether the print job is to be performed based on the relation between the number of printed sheets of the print job and the predetermined number of printed sheets in the present embodiment, but other embodiments may be applied.

For example, the image forming apparatus 1 may be configured so as to determine whether a print job is to be performed in the sleep state using the number of printed pages, or a print amount related to the print operation, such as a drive amount or a drive time of a drive unit, such as an image forming unit 129 or a photoconductor drum 130, instead of the number of printed sheets.

Furthermore, an image forming apparatus using electrophotographic has been exemplified in the present embodiment, but an image forming apparatus using an inkjet system or other systems can be similarly applicable.

Second Embodiment

Figure 8:
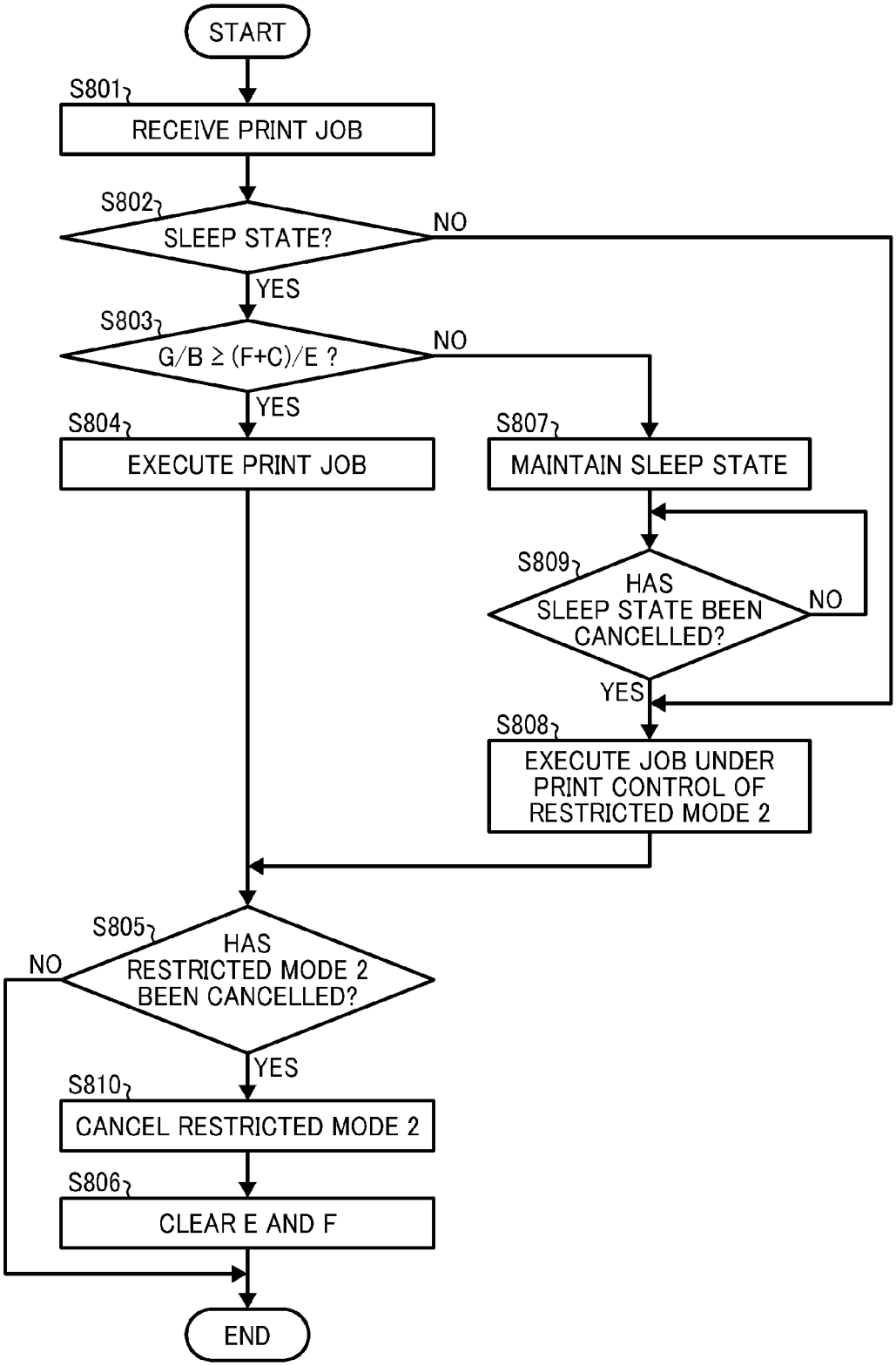
FIG. 8 is a flowchart for explaining print control when an image forming apparatus according to an embodiment of the present disclosure is in a restricted mode 2.

FIG. 8 is a flowchart for explaining print control when an image forming apparatus 1 according to the present embodiment is in a restricted mode 2.

As illustrated in FIG. 8, while the image forming apparatus 1 is in the restricted mode 2, when an input-output controller 162 receives a print job C (S801), a print controller 168 determines whether the image forming apparatus 1 is in a sleep state (S802).

When determining that the image forming apparatus 1 is in the sleep state in the determination processing in S802 (S802/YES), the print controller 168 determines whether a printing pace after transitioning to the restricted mode 2 (hereinafter, referred to as a "post-transition printing pace") exceeds the upper limit of the printing pace in the restricted mode 2 (hereinafter, referred to as a "maximum printing pace") assuming that the print job C is performed (S803). Here, the printing pace indicates the number of printed sheets per unit time.

In other words, when determining that the image forming apparatus 1 is in the sleep state in the determination processing in S802 (S802/YES), the print controller 168 determines whether the following condition is satisfied assuming that the print job C is performed (S803): $G/B \geq (F+C)/E$, where G indicates the continuous printing upper limit number (sheets), B indicates the sleep time (seconds), F indicates the cumulative number of printed sheets after transitioning to the restricted mode 2 (sheets), C indicates the number of printed sheets of the print job received in S801 (sheets), and E indicates the elapsed time after transitioning to the restricted mode 2.

Here, an elapsed-time counter 167 counts the elapsed time E, and a print counter 166 counts the cumulative number of printed sheets F as a cumulative print amount. In the present embodiment, the print controller 168 functions as a unit-print-amount calculator, and the number of printed sheets per unit time is calculated as a unit print amount.

Although the print controller 168 performs the print job C in S804, the post-transition printing pace does not exceed the maximum printing pace. Accordingly, when determining that $G/B \geq (F+C)/E$ is satisfied (S803/YES), the print controller 168 controls the print operation to perform the print job C although the image forming apparatus 1 is in the sleep state (S804).

Then, when the restricted mode 2 is a cancellable temperature (S805/YES), the print controller 168 cancels the restricted mode 2 (S810), clears the elapsed time E after transitioning to the restricted mode 2 and the cumulative number of printed sheets F after transitioning the restricted mode 2 to zero (S806), and terminates the print control in the restricted mode 2.

Here, the reason that E and F are reset to zero is to prevent the internal temperature from rising due to the large number of printed sheets in the sleep state generated by the continuity of the intermittent print control after the cancel of the restricted mode 2 and the print control are repeated.

On the other hand, when determining that the image forming apparatus 1 is not in the sleep state in the determination processing in S802 (S802/NO), the print controller 168 controls the print operation to perform the print job C in the intermittent print control (S808), and performs the processing in S805.

Furthermore, when determining that the post-transition printing pace exceeds the maximum printing pace, that is, $G/B \geq (F+C)/E$ is not satisfied assuming that the print job C is performed in the determination processing in S803 (S803/NO), the print controller 168 maintains the sleep state (S807).

Then, when the sleep state is cancelled and the image forming apparatus 1 transitions to the printable state (S809/YES), the print controller 168 controls the print operation to perform the print job C in the intermittent print control (S808), and performs the processing in S805.

As described above, when receiving a print job in the sleep state in the restricted mode 2, the image forming apparatus 1 according to the present embodiment is configured to perform the print job only if the post-transition printing pace is the maximum printing pace or less. Thus, although performing the print job C in the sleep state in the restricted mode 2, the image forming apparatus 1 according to the present embodiment can suppress rising of the internal temperature.

Accordingly, the image forming apparatus 1 according to the present embodiment can achieve both convenience and suppressing rising of the internal temperature without adding a cooling device, such as a cooling fan or a duct. Thus, the image forming apparatus 1 according to the present embodiment can suppress rising of the internal temperature with a simple configuration without deteriorating convenience.

Note that, the determination processing of S803 is performed in the sleep state in the present embodiment, but the image forming apparatus 1 may be configured to constantly perform the determination processing of S803 when being in the restricted mode 2 including the printable state. With this configuration, it is possible to efficiently suppress rising of the internal temperature.

Note that, the image forming apparatus 1 is not limited to the embodiment in FIG. 1, and may be an image forming apparatus having a system in which an image is directly formed on a sheet, that is, a direct transfer system. Furthermore, the image forming apparatus 1 is not limited to the color image forming apparatus illustrated in FIG. 1, and may be a monochrome image forming apparatus.

Figure 9:
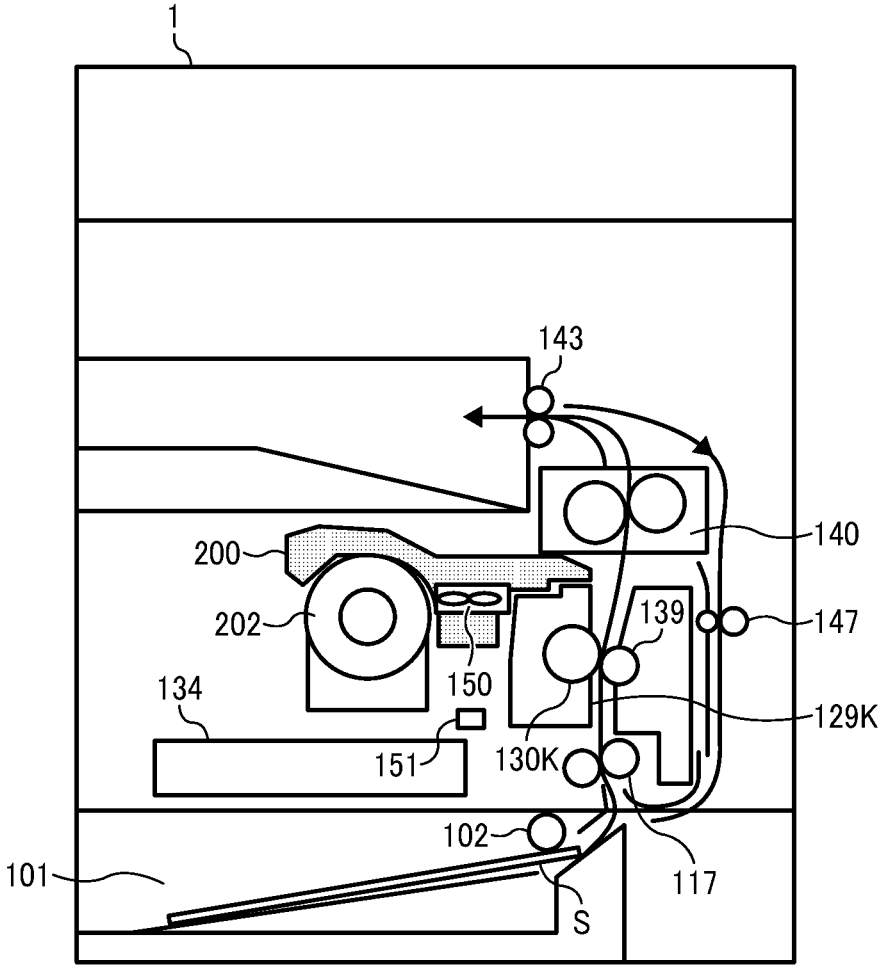
FIG. 9 is a diagram illustrating an example of a direct transfer system monochromatic image forming apparatus.

FIG. 9 is an example of a direct transfer system monochromatic image forming apparatus. The configurations to which the same reference codes as FIG. 1 indicate the same functions as FIG. 1, and redundant descriptions thereof are omitted below.

A fan 150 is to take in outside air, and sends the taken-in outside air to a duct 200. The sent airflow is discharged from an outlet of the duct 200 toward an upper surface of an image forming unit 129K and an outer circumferential surface of a toner container 202. Thus, it is possible to suppress toner fusing due to rising of the internal temperature of the image forming unit 129K, and fusing of the toner inside the toner container 202 before sending the toner to the image forming unit 129K.

The image forming apparatus illustrated in FIG. 9 has a reverse passage shorter than that in FIG. 1, and the device is small. Accordingly, if the number of sheets S on both of whose surfaces an image is formed increases, the temperature of the periphery of the image forming unit 129K rises due to heat of the sheets S. Thus, it is possible to cool the periphery of the image forming unit 129K, if the air volume of the fan or the number of fans is increased, but which generates disadvantages of noise or upsizing of the device.

Thus, if the above described embodiments is applied to the image forming apparatus illustrated in FIG. 9, it is possible to similarly suppress rising of the internal temperature with a simple configuration without deteriorating convenience.

Numerous additional modifications and variations are possible in light of the above teachings. It is therefore to be understood that within the scope of the appended claims, the disclosure of the present invention may be practiced otherwise than as specifically described herein. For example, elements and/or features of different illustrative embodiments may be combined with each other and/or substituted for each other within the scope of this disclosure and appended claims.

Each of the functions of the described embodiments may be implemented by one or more processing circuits or circuitry. Processing circuitry includes a programmed processor, as a processor includes circuitry. A processing circuit also includes devices such as an application specific integrated circuit (ASIC), digital signal processor (DSP), field programmable gate array (FPGA), and conventional circuit components arranged to perform the recited functions.

As described above, the present invention can be implemented in any convenient form, for example using dedicated hardware, or a mixture of dedicated hardware and software. The present invention may be implemented as computer software implemented by one or more networked processing apparatuses. The network can comprise any conventional terrestrial or wireless communications network, such as the Internet. The processing apparatuses can compromise any suitably programmed apparatuses such as a general purpose computer, personal digital assistant, mobile telephone (such as a WAP or 3G-compliant phone) and so on. Since the present invention can be implemented as software, each and every aspect of the present invention thus encompasses computer software implementable on a programmable device. The computer software can be provided to the programmable device using any storage medium for storing processor readable code such as a floppy disk, hard disk, CD ROM, magnetic tape device or solid state memory device.

What is claimed is:

1. A control device for an image forming apparatus that transitions to a restricted mode which is a print mode to alternately transition between a printable state to perform a print operation, in which a threshold print amount is printable, and a sleep state to stop a subsequent print operation for a threshold sleep time after the print operation is performed, the control device comprising:

at least one processor configured to execute computer-readable instructions to, determine, when a print-operation execution request to the image forming apparatus is received in the sleep state, whether the image forming apparatus is to perform the subsequent print operation in the sleep state based on a print amount of the print-operation execution request; and control the subsequent print operation of the image forming apparatus according to the determination as to whether the image forming apparatus is to perform the subsequent print operation.

2. The control device according to claim 1, wherein the at least one processor is configured to execute the computer-readable instructions to determine to perform the subsequent print operation when the print amount of the print-operation execution request is equal to or less than the threshold print amount.

3. The control device according to claim 1, wherein the at least one processor is configured to execute the computer-readable instructions to control a further subsequent print operation of the image forming apparatus to change the threshold sleep time to be longer than a time length having been set before the subsequent print operation after the image forming apparatus performs the subsequent print operation in the sleep state.

4. The control device according to claim 1, wherein the at least one processor is configured to execute the computer-readable instructions to control a further subsequent print operation of the image forming apparatus to change the threshold sleep time to be longer than a time length having been set before the subsequent print operation by a difference between the time length and an elapsed time from a transition to the sleep state until the subsequent print operation is performed after the image forming apparatus performs the subsequent print operation in the sleep state.

5. The control device according to claim 1, wherein the at least one processor is configured to execute the computer-readable instructions to, measure an elapsed time after the image forming apparatus transitions to the restricted mode;

measure a cumulative print amount of the image forming apparatus after the image forming apparatus transitions to the restricted mode; and calculate, based on the measured elapsed time and the measured cumulative print amount, a unit print amount which is a print amount per unit time after the image forming apparatus transitions to the sleep state, wherein when the print-operation execution request is received while the image forming apparatus is in the sleep state, the at least one processor is configured to determine whether the image forming apparatus is to perform the print operation based on the unit print amount calculated by assuming that the print-operation execution request is performed.

6. The control device according to claim 5, wherein the at least one processor is configured to execute the computer-readable instructions to determine that the image forming apparatus is to perform the print operation if the unit print amount calculated by assuming that the print-operation execution request is performed is equal to or less than a threshold unit print amount.

7. The control device according to claim 5, wherein the at least one processor is configured to execute the computer-readable instructions to clear the measured elapsed time and the measured cumulative print amount to zero when the image forming apparatus is cancelled from the restricted mode.

8. The control device according to claim 5, wherein the at least one processor is configured to execute the computer-readable instructions to determine, whether the image forming apparatus is to perform the print operation based on the unit print amount calculated by assuming that the print-operation execution request is performed when the print-operation execution request is received while the image forming apparatus is in the restricted mode.

9. The control device of claim 1, wherein the at least one processor is configured to execute the computer-readable instructions to transition the image forming apparatus to the restricted mode when an internal temperature of the image forming apparatus increases above a first threshold or decreases below a second threshold.

10. The control device of claim 1, wherein the at least one processor is configured to execute the computer-readable instructions to determine not to perform the subsequent print operation in the sleep state when the print operation remains.

11. The control device of claim 1, wherein the at least one processor is configured to execute the computer-readable instructions to, determine a remaining time for the sleep state; and change the remaining time based on whether the processor determines the image forming apparatus is to perform the subsequent print operation in the sleep state.

12. The control device of claim 11, wherein the at least one processor is configured to execute the computer-readable instructions to, increase the remaining time when the processor determines the image forming apparatus is to perform the subsequent print operation in the sleep state.

13. A non-transitory recording medium storing a control program for causing an image forming apparatus that transitions to a restricted mode which is a print mode to alternately transition between a printable state to perform a print operation, in which a threshold print amount is printable, and a sleep state to stop a subsequent print operation for a threshold sleep time after the print operation is performed, to execute:

determining, when a print-operation execution request to the image forming apparatus is received in the sleep state, whether the image forming apparatus is to perform the subsequent print operation in the sleep state based on a print amount of the print-operation execution request; and controlling the subsequent print operation of the image forming apparatus according to a determination result as to whether the image forming apparatus is to perform the subsequent print operation.

14. A method for controlling an image forming apparatus that transitions to a restricted mode which is a print mode to alternately transition between a printable state to perform a print operation, in which a threshold print amount is printable, and a sleep state to stop a subsequent print operation for a threshold sleep time after the print operation is performed, the method comprising:

determining, when a print-operation execution request to the image forming apparatus is received in the sleep state, whether the image forming apparatus is to perform the subsequent print operation in the sleep state based on a print amount of the print-operation execution request; and controlling the subsequent print operation of the image forming apparatus according to a determination result as to whether the image forming apparatus is to perform the subsequent print operation.

15. The method of claim 14, further comprising:

transitioning the image forming apparatus to the restricted mode when an internal temperature of the image forming apparatus increases above a first threshold or decreases below a second threshold.

16. The method of claim 14, wherein the determining determines not to perform the subsequent print operation in the sleep state when the print operation remains.

17. The method of claim 14, further comprising:

determining a remaining time for the sleep state; and changing the remaining time based on whether determining.

18. The method of claim 17, further comprising:

increasing the remaining time when the image forming apparatus is determined to perform the subsequent print operation in the sleep state.

* * * * *